US006957504B2

(12) United States Patent
Morris

(10) Patent No.: US 6,957,504 B2
(45) Date of Patent: Oct. 25, 2005

(54) FOOTWEAR WITH SURROUNDING ORNAMENTATION

(75) Inventor: Christopher Hayes Morris, Topanga Canyon, CA (US)

(73) Assignee: Sculpted Footwear LLC, Topanga Canyon, CA (US)

( * ) Notice: Subject to any disclaimer, the term of this patent is extended or adjusted under 35 U.S.C. 154(b) by 0 days.

(21) Appl. No.: 10/347,078

(22) Filed: Jan. 17, 2003

(65) Prior Publication Data

US 2004/0148805 A1 Aug. 5, 2004

(51) Int. Cl.[7] ..... A43B 23/00

(52) U.S. Cl. ..... 36/136; 36/1; 36/112; D2/897; D2/948

(58) Field of Search ..... 36/1, 132, 136, 36/112, 137, 139; D2/897, 898, 899, 948, 976

(56) References Cited

U.S. PATENT DOCUMENTS

| | | | |
|---|---|---|---|
| D67,767 S | | 7/1925 | Richards |
| D70,672 S | | 7/1926 | Hoffman |
| 1,659,874 A | | 2/1928 | Jacobs |
| D139,601 S | * | 12/1944 | Casso ..... D2/899 |
| D167,834 S | | 9/1952 | Hildebrand |

(Continued)

FOREIGN PATENT DOCUMENTS

| | | | |
|---|---|---|---|
| WO | 02/052972 | * | 7/2002 |

OTHER PUBLICATIONS

"About ICON"; http://www.iconshoes.com/about/; Dec. 16, 2002.

"BIONICLE by Nike" http://www.lego.com/eng/bionicle/nike.asp.

*Primary Examiner*—M. D. Patterson
(74) *Attorney, Agent, or Firm*—Greenberg Traurig, LLP; Enrica Bruno

(57) ABSTRACT

A shoe upper has an outside surface having a first ornamental theme, the first theme being formed in three dimensions, with artwork coincident with the three dimensional effect. An outsole below the shoe upper includes a bottom surface for engagement with a walking surface; a peripheral area extending about the bottom and mating with the upper. The upper surface is for engagement with a bottom of the upper. The bottom surface and the peripheral area have a surface with a second ornamental theme. The first ornamental theme and the second ornamental theme are thematically related so as to create a surrounding ornamentation of the footwear.

25 Claims, 10 Drawing Sheets

U.S. PATENT DOCUMENTS

| | | | | | |
|---|---|---|---|---|---|
| D191,575 | S | * | 10/1961 | Pool | D2/899 |
| D217,532 | S | | 5/1970 | Sherman | |
| 3,568,339 | A | * | 3/1971 | Hara et al. | 36/87 |
| 3,906,642 | A | * | 9/1975 | Cohen | 434/260 |
| D238,017 | S | * | 12/1975 | Cohen | D2/897 |
| D238,216 | S | * | 12/1975 | Cohen | D2/897 |
| D240,170 | S | | 6/1976 | Cohen | |
| 4,050,167 | A | * | 9/1977 | Senter | 36/32 R |
| D259,296 | S | | 5/1981 | Meyer | |
| D261,195 | S | * | 10/1981 | Weiss | D2/898 |
| D261,325 | S | * | 10/1981 | Niro | D2/897 |
| D278,608 | S | | 4/1985 | Thompson | |
| D290,062 | S | | 6/1987 | Valori | |
| 4,712,319 | A | * | 12/1987 | Goria | 36/137 |
| D329,125 | S | | 9/1992 | Hatfield | |
| D329,731 | S | | 9/1992 | Adcock et al. | |
| D341,474 | S | * | 11/1993 | Winters | D2/897 |
| D343,948 | S | * | 2/1994 | Smith | D2/977 |
| D347,110 | S | | 5/1994 | Hoeft et al. | |
| 5,331,753 | A | | 7/1994 | Rodibaugh | |
| 5,465,507 | A | | 11/1995 | Schumacher et al. | |
| D366,752 | S | | 2/1996 | Sherman | |
| 5,673,501 | A | | 10/1997 | Mathews | |
| 5,734,991 | A | | 4/1998 | Schmid | |
| D394,137 | S | * | 5/1998 | Nadel | D2/898 |
| 5,765,300 | A | | 6/1998 | Kianka | |
| D396,946 | S | * | 8/1998 | Loverin | D2/912 |
| 5,822,885 | A | | 10/1998 | Loverin | |
| 5,839,211 | A | | 11/1998 | Pallera | |
| D403,494 | S | | 1/1999 | Loverin | |
| D410,961 | S | * | 6/1999 | George | D2/897 |
| 5,979,085 | A | | 11/1999 | Ross et al. | |
| D417,771 | S | | 12/1999 | Blanco | |
| D422,778 | S | | 4/2000 | Yang | |
| D423,197 | S | | 4/2000 | Yang | |
| 6,080,033 | A | | 6/2000 | Fladwood et al. | |
| 6,226,896 | B1 | | 5/2001 | Friton | |
| 6,276,074 | B1 | | 8/2001 | Martin | |
| D450,174 | S | | 11/2001 | Scotti | |
| 6,398,126 | B1 | | 6/2002 | Pitchford | |
| 6,412,197 | B1 | | 7/2002 | Krull | |
| 6,442,869 | B2 | | 9/2002 | Coomes | |
| 6,455,128 | B1 | | 9/2002 | Moon | |
| 6,475,051 | B1 | | 11/2002 | Griffin et al. | |
| 2002/0020082 | A1 | | 2/2002 | James | |
| 2002/0083623 | A1 | | 7/2002 | Joseph | |
| 2002/0159586 | A1 | | 10/2002 | Chiou | |

* cited by examiner

FOOTWEAR WITH SURROUNDING ORNAMENTATION

BACKGROUND

This invention relates to footwear generally. In particular, but not exclusively it relates to footwear for children. The footwear of the invention relates to ornamented and artistically creative footwear having desirable features associated with the footwear.

The footwear of the invention is in the form of a recreational or athletic shoe and may have a single or a multi-layer sole construction comprising an outer sole, a mid-sole, and insole. There is also an upper associated with the footwear, and all these components or elements of the footwear, are provided with desirable features.

It is an object with the present invention to provide footwear with features that are highly desirable to consumers.

SUMMARY OF THE INVENTION

According to the invention there is provided a shoe comprising a shoe upper having a volume for enclosing a wearer's foot, an outside surface of the upper having a first ornamental theme. The first theme is formed in three dimensions, and the rendition of features of the art is preferably coincident with the three dimensional effects. The footwear is such that the upper appears as a surrounding artwork or 360 degree artwork. As such the artwork on the upper preferably includes the medial and lateral quarters, the toe, vamp, heel and tongue regions of the footwear.

In some cases one or more of these sections of the footwear may not be artistically enhanced with the artwork. The overall preferred footwear effect however is for the majority, at least about 50 percent and preferably at least about 80 percent of the surface area to be artistically enhanced. Such enhancement is effected through a printing to effect a two dimensional artistic enhancement. Additionally on one or more of the footwear sections of the quarter, toe, heel, vamp or tongue there is three dimensional effect created by an embossing or debossing of the material of the upper. Preferably such embossing or debossing is a high frequency welding of discrete sections of the surface and such embossing or debossing is effected to be preferably coincident with artistic features of the art work on the surface thereby to enhance the footwear. The surface of the sections is enhanced by printed artwork.

There is a sole below the shoe upper which includes an outsole or bottom surface for engagement with a walking surface; a peripheral area or sidewall extending about the bottom surface and mating with the upper. An upper surface of the sole is for engagement with a bottom of the upper.

At least one of and preferably both the bottom surface and the peripheral area have a surface with a second ornamental theme. The first ornamental theme and the second ornamental theme are thematically related. As such this provides surrounding ornamentation for the shoe with a further three dimensional effect for the ornamental shoe. As such the footwear includes thematic artwork on the upper and the sole and is substantially embracive of the footwear in a surrounding sense or essentially or substantially 360 degree sense laterally and vertically.

The shoe preferably has a panoramic theme. The nature of the theme is preferably one of intrigue. This converts an essentially functional or utilitarian form of shoe to wearable surrounding art or ornamented footwear with an intriguing character or personality.

By the term "shoe" the Applicant means footwear generally. This can be in the nature of a conventional shoe, a boot different forms of shoe, for instance, dress shoe, athletic shoe, casual shoe, sandal or slipper. The shoe can be for children, babies or adults and can be for boys, girls, men or women.

In another preferred form of the invention the shoe comprises an outside surface of the upper having a first ornamental theme which is not necessarily in three dimensions. The first ornamental theme and the second ornamental theme are still thematically related to create an effective surround art shoe. An element of the first theme is formed with a material engaging an underlying substrate forming the upper. The material overlaps the peripheral area and is secured to the periphery area of the outsole, and in this manner provides a three dimensional effect.

In yet a further form of the invention where there is three dimensional characteristic the first ornamental theme, the theme is formed at least partly in three dimensions with a material having an embossed profile. The theme is formed in three dimensions with a material having an embossed profile along a first side of the upper. There can be an unembossed profile along another side of the upper. Where the embossed profile is used, the embossed profiling is coincident with the art form or representation to create a three dimensional art theme and effect.

The first theme can be formed of an animal walking on a ground surface. The second theme may include a ground surface on which the animal is represented to walk. The first theme can be formed of a dinosaur walking on a ground surface. The second theme can include a ground surface on which the dinosaur is represented to walk. This can include a representation of caked ground. The caked ground theme can extend to the bottom surface of the outsole, and the caked ground selectively represents at least one of mud or rocks.

The bottom surface and the peripheral area can have a surface with a second ornamental theme. The second theme can include a ground surface on which the dinosaur is represented to walk. It includes representation of caked ground. The caked ground theme extends to the bottom surface of the outsole and the caked ground selectively represents at least one of mud or rocks. The bottom surface includes an indentation of a footprint of the dinosaur.

In another form of the invention an element of the second theme is formed with a material such that the material from the peripheral area of the outsole overlaps upwardly to the area of the upper. It is suitably secured to the upper.

In yet a further form the first theme being formed of a feature moving over a terrain. The second theme included terrain on which the feature is represented to move.

At least one of the bottom or periphery of the outsole may be formed in multiple colors, and the colors are selectively may be selectively coordinated to colors of the first theme of the upper. This enhances the surround art theme of the shoe, so that an embracive mutlicolor effect is achieved. As such the art enhancing effect in the outsole may be formed to in a multi color construction, and preferably the art coloring in the outsole is complimentary to the art coloring in the upper. In a preferred form of the invention the artwork in the upper is at least two primary colors over the majority of the surface and the majority of the coloring in the sole includes the same two primary colors. Preferably, a major significant feature in the bottom of the sole conforms to one color and the surround area of the significant feature in the bottom of the sole is another color.

The upper can be formed of at least two materials. A first material may include foam thereby permitting embossing over the surface. A second material is without foam such that the material is not subject to embossing. The two materials are bonded to form an overall appearance for the upper which is partly embossed and partly unembossed.

The dinosaur can include a tail feature, the tail feature being made to at least partially wrap around a front of the upper from one side of the upper the another side of the upper. The dinosaur can include a mouth, jaw or teeth feature. The feature is made to at least partially wrap around a front toe region of the upper from one side of the upper the another side of the upper, the mouth or other featured being formed selectively with an embossed profile.

The system can be such that the footwear includes at least one of light emitting elements or sound emitting elements on the shoe. There would be a circuit generating means for the light or sound, and a power source for a circuit for the light or sound. The sound and/or light would preferably relate to the first or second thematic concepts.

Other features and advantages of the invention will be apparent from the following description and drawings.

DETAILED DESCRIPTION OF THE INVENTION

Figure 1:
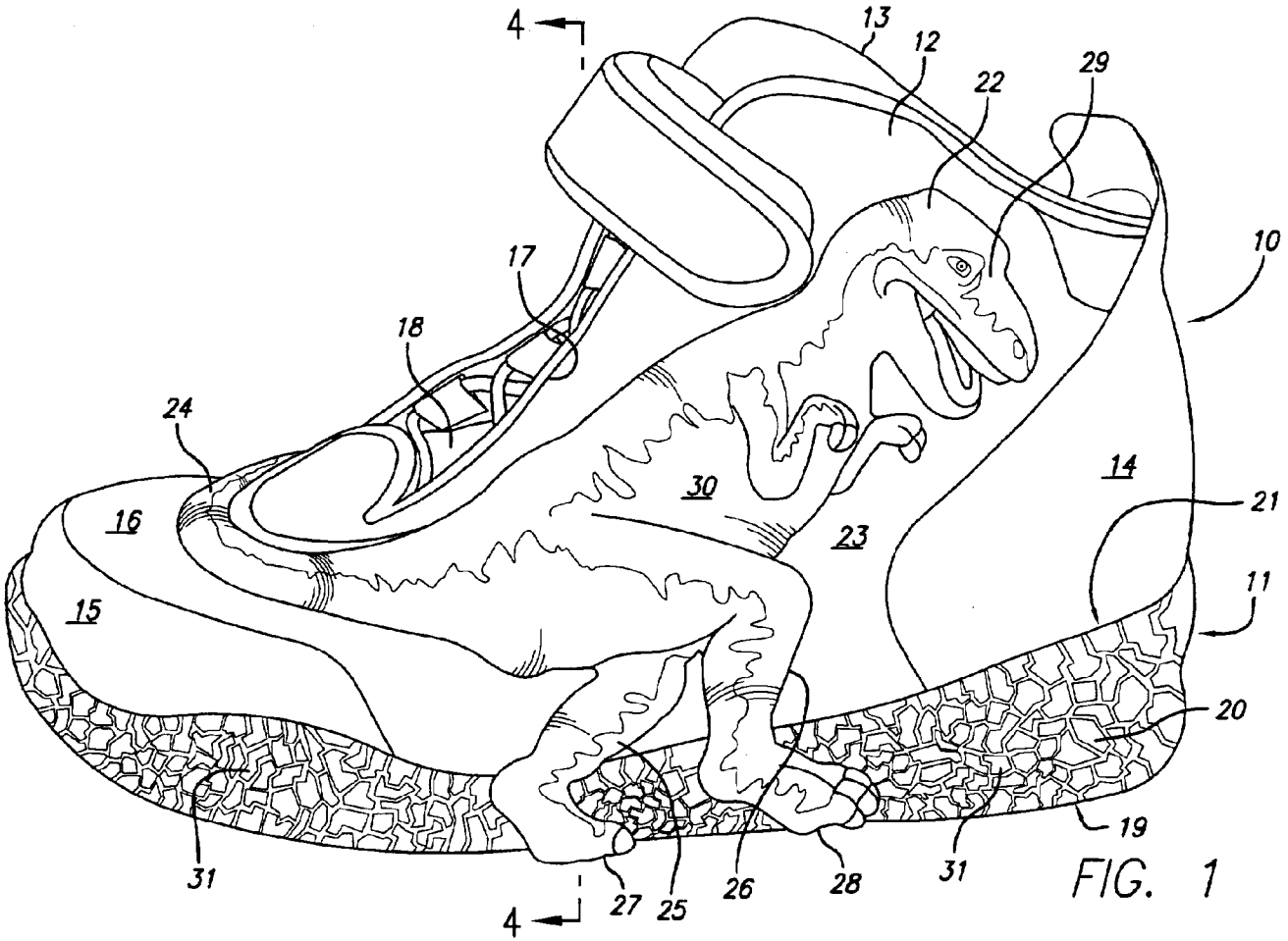
FIG. 1 is a perspective side view of one item of footwear in accordance with the invention.

Referring to FIG. 1 there is a high-top shoe or low boot structure which includes an upper 10 which is generally shown and an sole 11. The upper 10 includes an outer side portion or lateral quarter 12 and opposite side portion or medial quarter 13 and between the portions 12 and 13 there is a heel receiving area 14 and a toe cap area 15 between the toe cap area 15 and the side portions 12 and 13. There is also a top portion or vamp 16 where there is a U throat is formed by edges or eye stays 17 and between and underneath the edges there is a tongue 18.

The tsole 11 includes an outsole or bottom surface 19, a peripheral area or side wall 20 and an upper top line 21 of the sole 11. In the configuration shown in the figures the sole 11 is known as a cup sole construction which means that the sole is a single piece wrapping which includes the outsole and the sidewall. In other configurations there can be configuration of the sole where there is an intermediate sole or mid-sole which forms in large measure the sidewall of the overall sole configuration The upper 10 includes a first ornamental theme, the theme being illustrated in FIG. 1 is that of a dinosaur 22. The dinosaur 22 is formed in 3 dimensions, namely it is raised above the surface 23 of the side of the upper 12. The dinosaur representation 22 is shown with its head portion at a location on the side of the upper which is in a general ankle area of the high top in FIG. 1 and the dinosaur body is located along the side where the outside of the foot would be located.

The tail portion 24 of the dinosaur 22 wraps around the front of the U throat 17 around the top 16 of the upper. As such the tail portion 24 is located between the toe cap portion 15 and the U throat 17. The two legs 25 and 26 of the dinosaur are formed to depend downwardly and extend past the interface line 21 of the sole 11 and be affixed to the periphery 22 of the sole 11. The bottoms 27 and 28 of the feet of the dinosaur are essentially flush with the bottom surface 19 of the sole 11.

The dinosaur 22, from the head region 29 to the body region 30, the tail 24, the legs 25 and 26, and the feet 27 and 28 forms a three-dimensional feature, image or ornamental theme mounted on top of the shoe upper 12. The three-dimensional feature overlaps the sole 11 and likewise forms a three-dimensional theme or feature in relation to the sole 11.

Referring further to the outsole 11 it can be seen that the sidewall 20 is formed to represent a caked appearance. This is representative of a second ornamental theme, namely representing the terrain in which a dinosaur 22 would live. This caked ground appearance is formed by cells 31 all about the peripheral area 20 of the sole 11 is an embracing ornamental theme for the sole. The cells 31 are repeated as cells 32 in the bottom area 19 of the sole 11.

Also part of theme of the sole 11 in the bottom 19 there is formed a footprint 33 which would represent the claw of a dinosaur 22. The footprint has a base area 34 and three claws 35, 36 and 37 in the forward part. The footprint 33 is inset in a peripheral area 38 such that there is a ridge 39 running between the periphery of the cells 32 and the footprint.

The theme as formed on the sole 11 thus relates to the theme on the upper in a thematical way so that the footwear represents all-around or surround or embracing art encompassing footwear. In this case there is the dinosaur and the terrain of the dinosaur and different anatomical attributes of the dinosaur.

On the opposite side 13, namely the inner side of the shoe, there may or may not be additional art and the art there may include the two or three-dimensional representation of a dinosaur or other terrain features of the physical area in which a dinosaur would have lived. This could be forestation, rocks, desert, tundra or the like.

Figure 2:
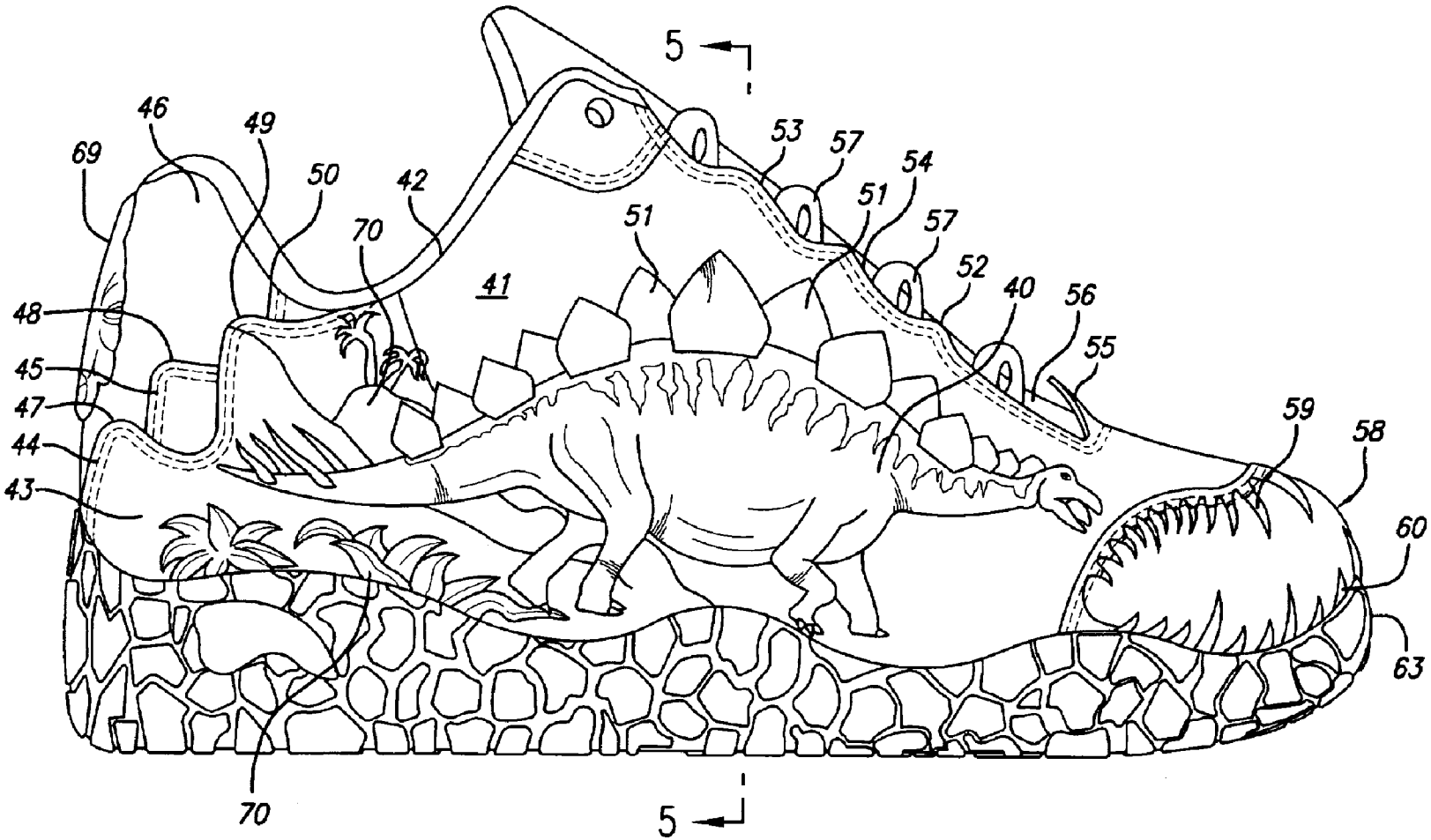
FIG. 2 is a side view of a second item of footwear in accordance with the invention.

In yet further elaborations of the footwear of the invention, there is shown in FIG. 2 a different dinosaur configuration 40. That dinosaur is wholly mounted on the outside surface 41 of the side portion 42 of the upper 43. The upper 43 is formed of different component parts of material.

There is a component part 44 which is stitched to an under part 45 and in turn formed on the heel portion 46. This can be seen by the peripheral edges 47 and 48 of the component parts 44, 45. The edge effect formed by 47, 48, 49 and 50 represents a scaly appearance as formed by the material end stitching. That scaly relates to the scales 51 on the back of the dinosaur 40. There is thus an integrated relationship between the artwork of the dinosaur 40 and the upper material 41.

The U throat 52 is likewise formed by undulations with raised portions 53 and pressed portions 54 and also a tongue area 55. Within the U portion there is a conventional show tongue 56 with lace-up areas and loops 57. The undulations formed by the profile of the U throat as formed by sections 53 and 54 also represent an undulating surface related to the undulating surface of the artistic design representation 51 on the back of the dinosaur 40.

In the toe region 58 of the footwear there are sets of teeth 59 and 60 which are representative of the teeth of the dinosaur. This can be formed integrally in the toe cap of the footwear and can be formed in an embossed manner or three dimensional manner to protrude from the underlying surface or substrate forming the toe cap 58.

The dinosaur 40 can also be formed in a three dimensional effect and as such can be embossed on or into the surface 41 of the upper 42. As such the material forming the side of the footwear in a three-dimensional manner is an embossed structure of a single material forming the three-dimensional effect. There can be an appropriate pattern inlay inside the footwear.

Figure 3:
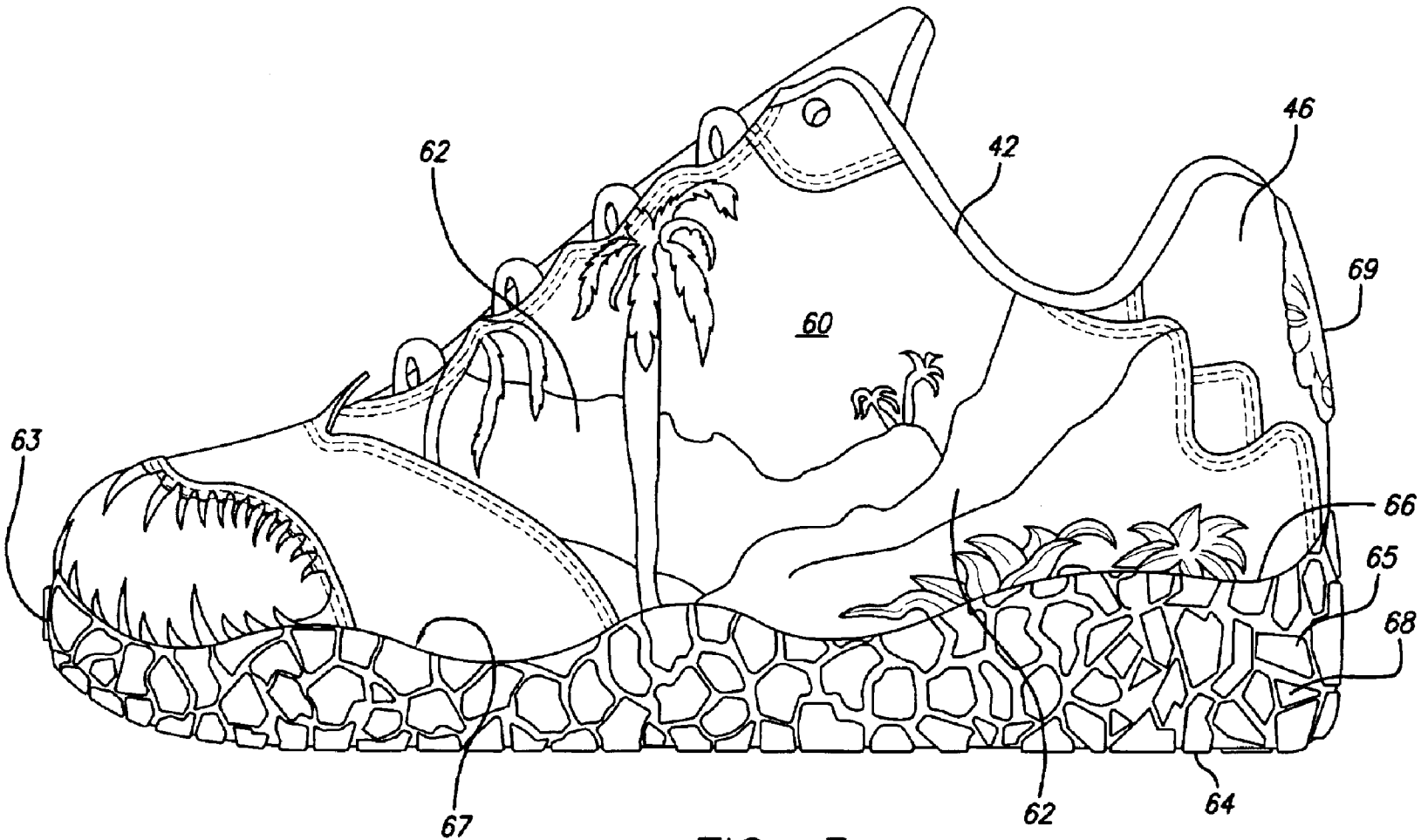
FIG. 3 is an opposite side view of the footwear illustrated in FIG. 2.

The opposite side of the shoe shown in FIG. 2 is represented in FIG. 3. Here on the side 61 of the upper 42 there is an artistic representation 62 which is shown in a two-dimensional format. In this representation of the footwear there is a combination therefore of both three-dimensional and two-dimensional effect to form the first thematic characteristics of the shoe upper.

Figure 7:
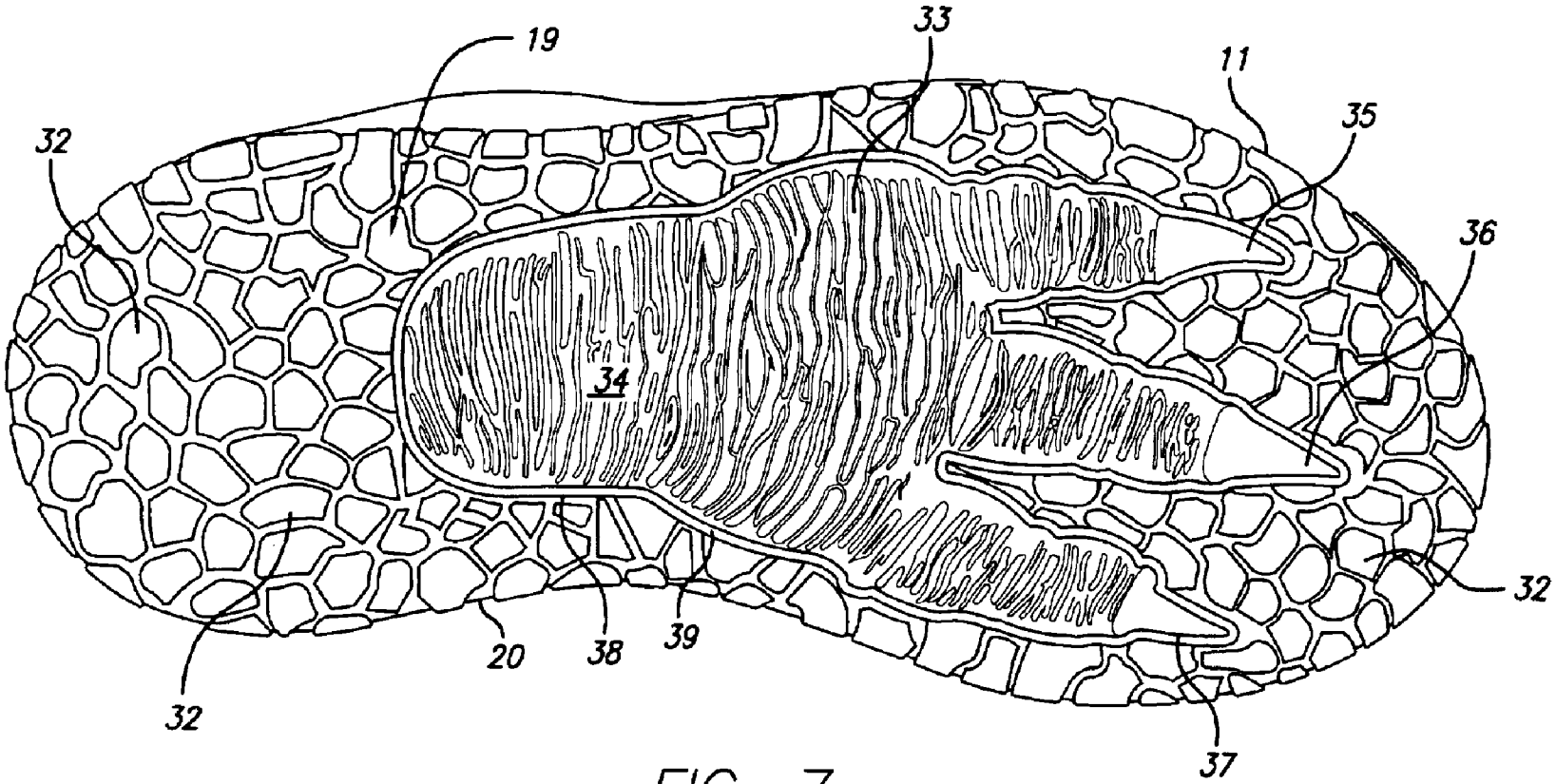
FIG. 7 is an under view of one embodiment of the outsole in accordance with the invention.
Figure 8:
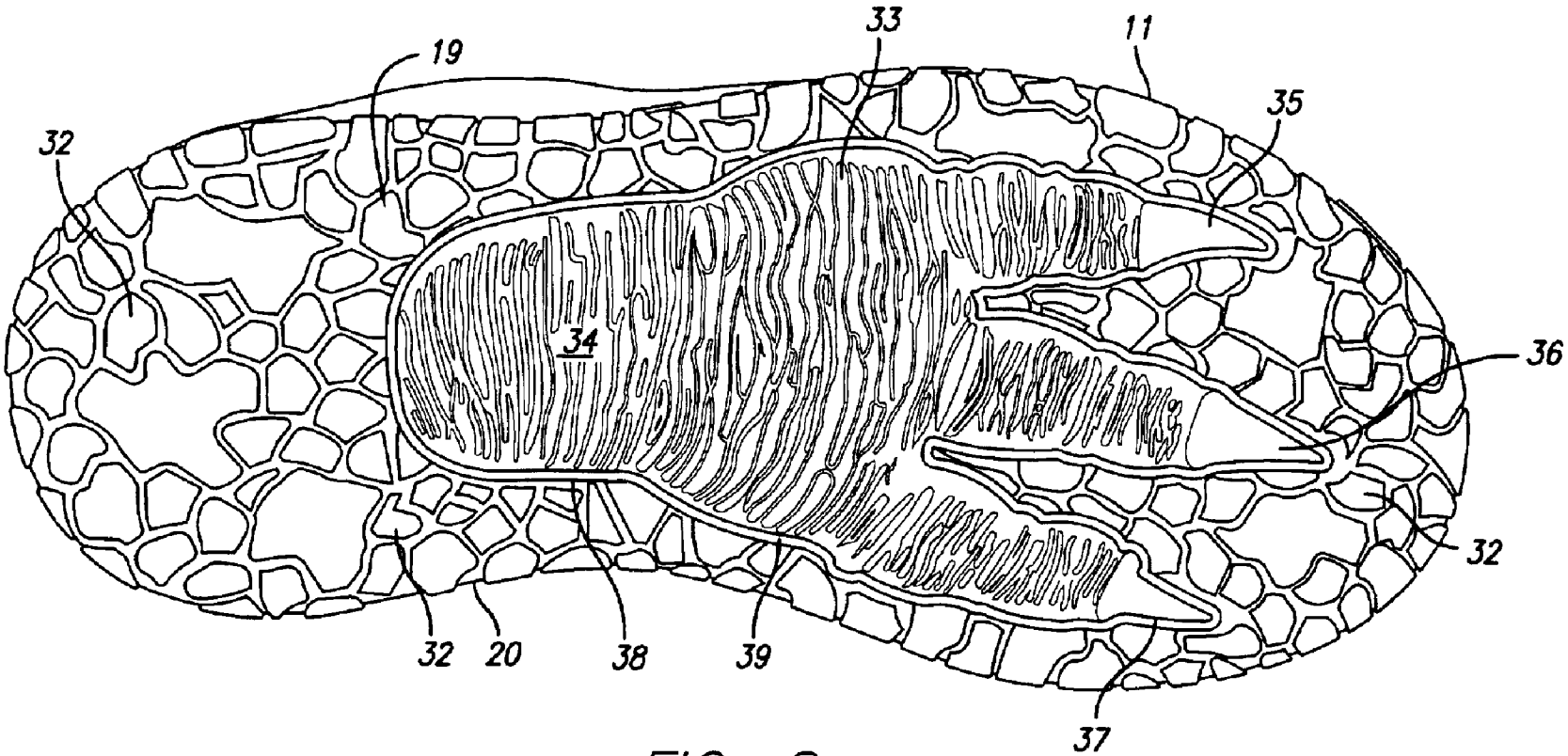
FIG. 8 is another embodiment of the under views of the outsole of footwear in accordance with the invention.
Figure 9:
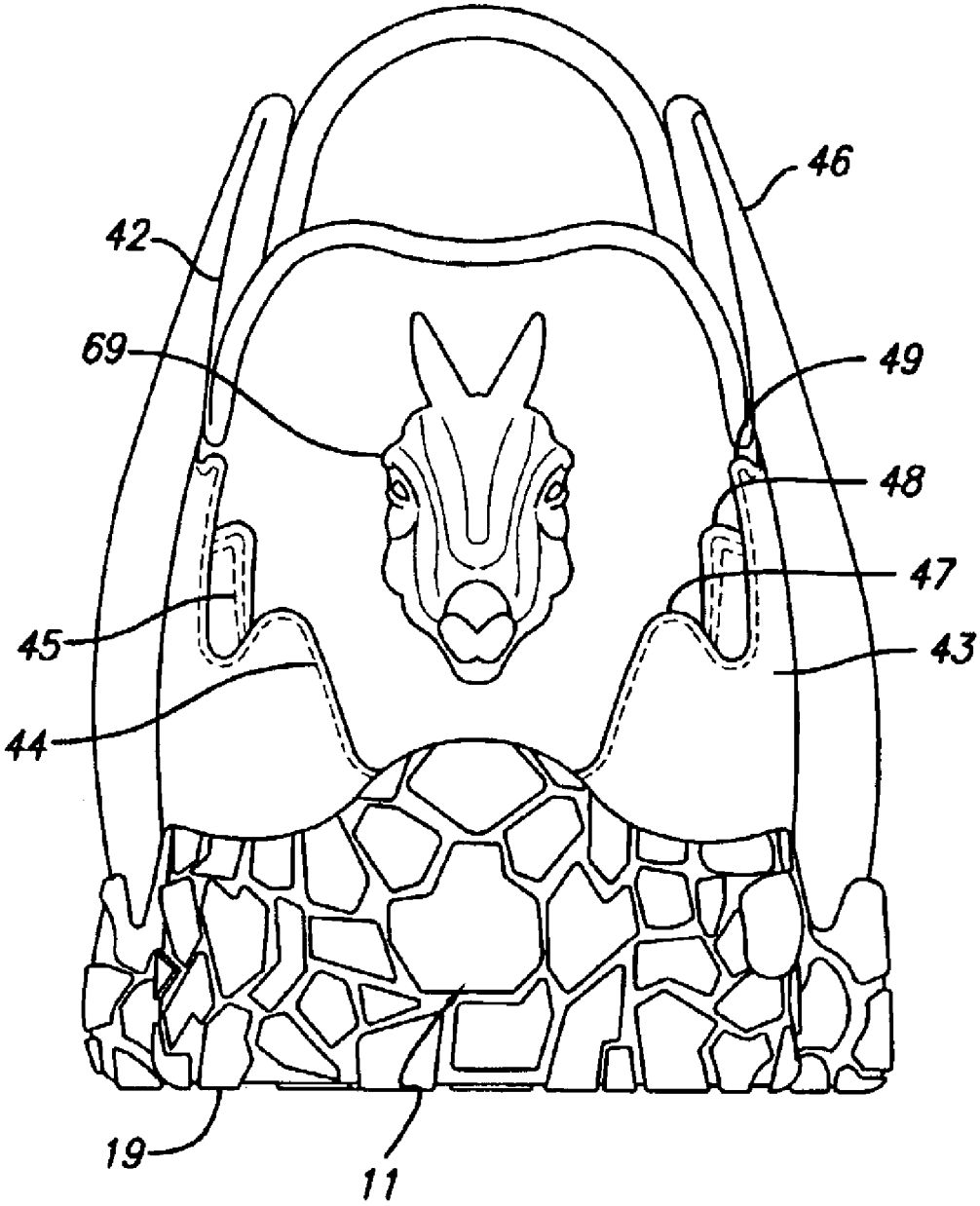
FIG. 9 is a rear view of an embodiment of footwear in accordance with the invention.
Figure 10:
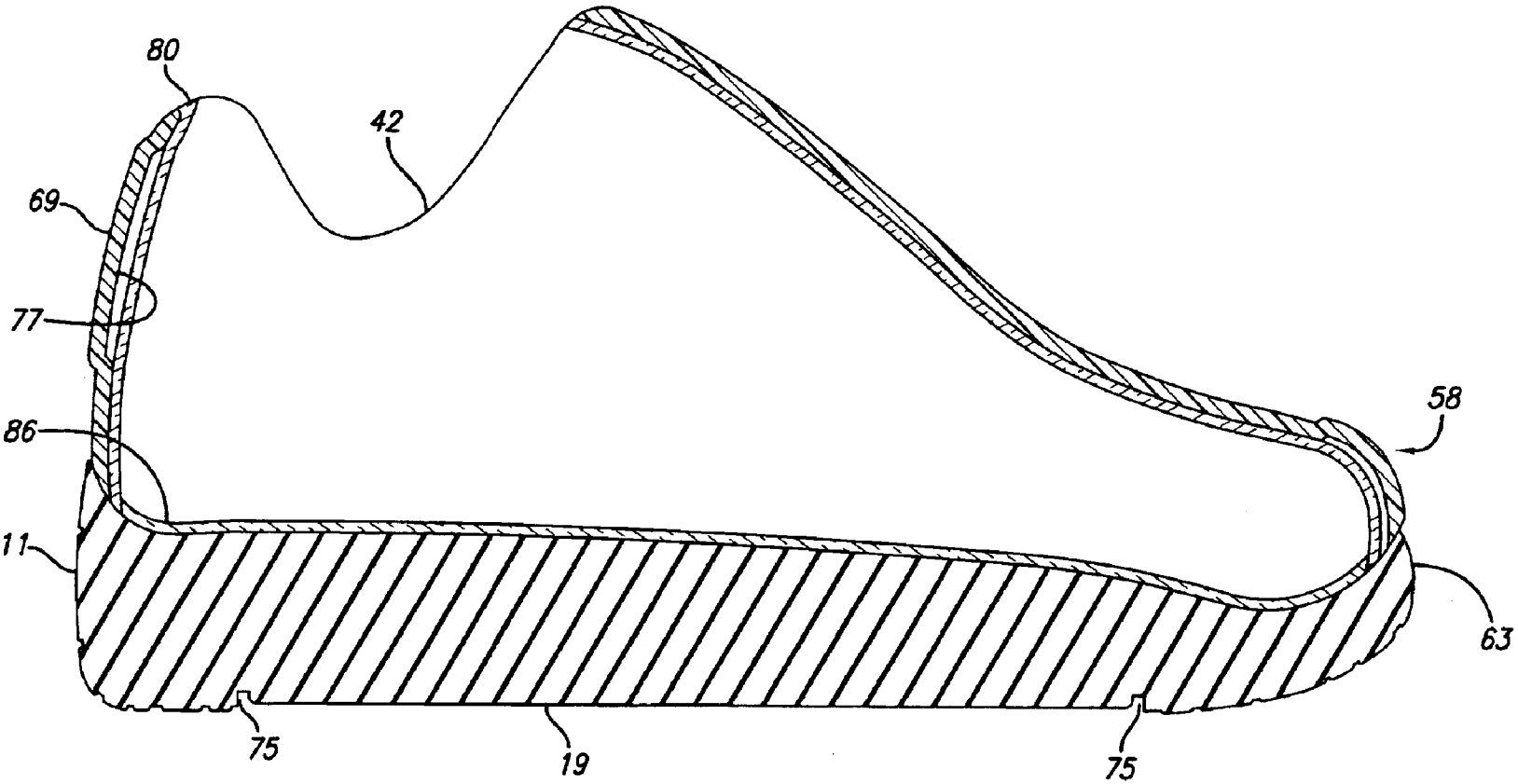
FIG. 10 is a side cross section of footwear in accordance with the invention

The outsole 63 of the shoe shown in FIGS. 2 and 3 is formed with a bottom surface 64, a side peripheral area 65, and a top or upper surface 66. The top line 66 of the side wall of the sole interfaces with the new upper 42 where an undulating pattern 67 is formed. This could be representative of hills and an environment in which a dinosaur would live or move. The bottom surface of the sole 63 would be similar to that shown in FIG. 7 or in FIG. 8, which is an alternative variation. The side peripheral area 65 has the cells 68 which are representative of rocks. Similar cells are formed in the bottom of the footwear.

Also formed in the heel area 46 of this footwear is a three-dimensional mask or head effect. This mask or head effect 69 is formed likewise by embossing the material formed in the heal portion 46 of the shoe. The face effect for element 69 would also relate to the theme formed in the upper of the shoe. In addition to showing a dinosaur 40 in this shoe and the background appearance 62 additional background appearances can be provided to the shoe in the form of artistic printing 70 on the surface 41 of the upper 42. The effect of the artistry and rendition in printing on the upper surfaces 41 and 61 is to make the appearance of the shoe totally embracive of an artistic rendition relating to the first theme of the shoe. The second theme as represented on the sole 63 blends with the first theme. Thus the second theme upon the sole is thematically related to the first theme so that both themes are related.

Figure 4:
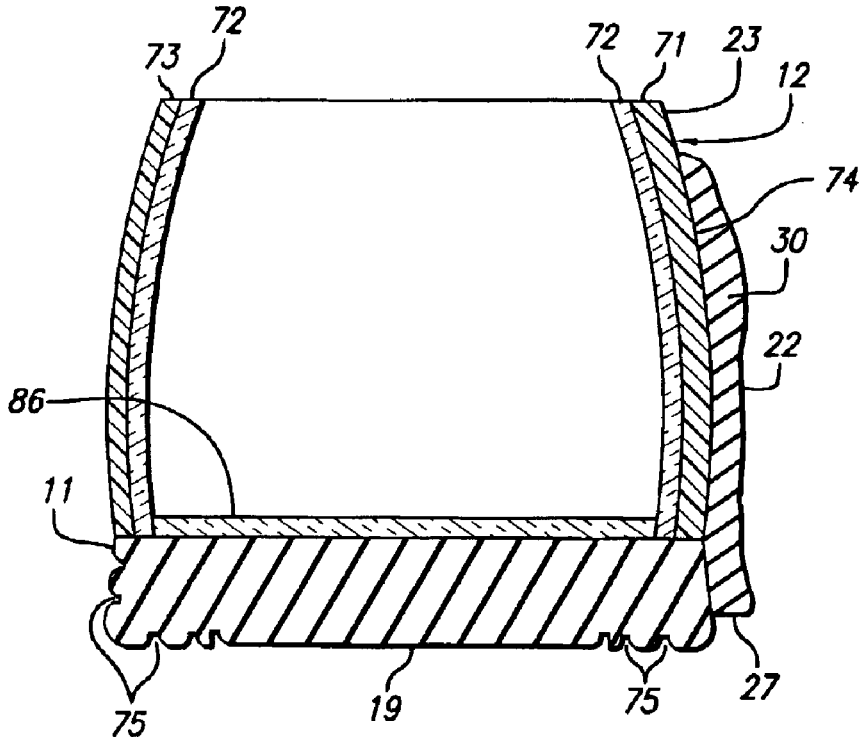
FIG. 4 is a sectional view of the footwear of FIG. 1 along line 4—4.

FIG. 4 is a cross-sectional side view of the footwear in FIG. 1. As such the three-dimensional effect as created by the dinosaur 22 can be seen so that the body 30 is affixed to the surface 23 of the side wall of the upper 12. That is on one side of the shoe. The foot 27 is shown above the bottom 19 of the outsole 11. In other cases the foot 27 can be substantially level with the bottom 19.

The side of the upper 12 of the shoe is formed by two materials 71 which is an outer material and an inner cushioning material 72. On the inside of the shoe there is a cushioning material 72 and a different outer material 73. Thus, the material 71 is relatively thicker than the material 73. In other cases the material 71 can be the same as the material 73. The dinosaur 22 itself can be adhesively connected at the interface 74 between the dinosaur 22 and the surface 23 of the material 71 of the upper 12. This can be seen in the open areas 75 in the bottom of the outsole 11. The formation forming the cells and the footprint are inset from the outer area of the bottom 12 of the outsole.

Figure 5:
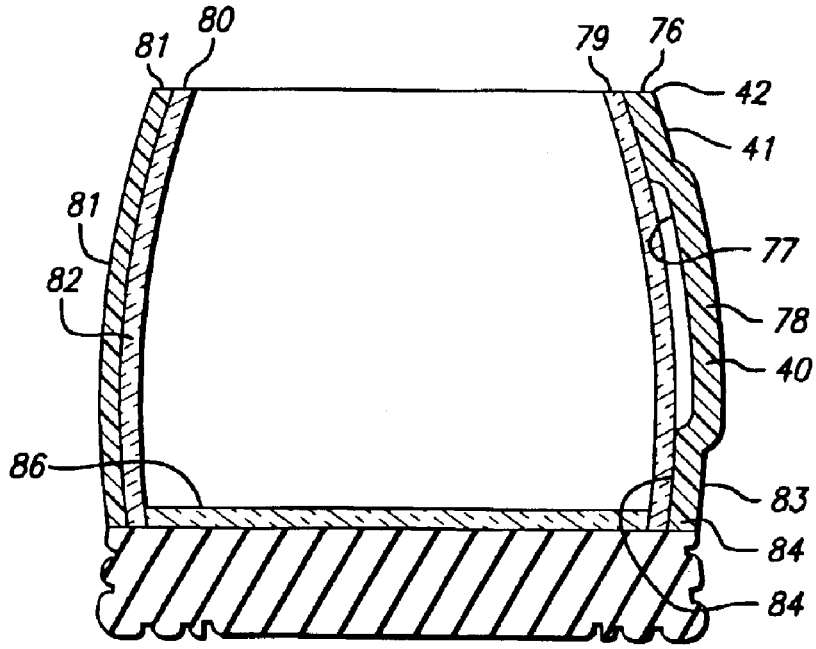
FIG. 5 is a cross-sectional view of the footwear of FIG. 2 along line 5—5.

As shown in FIG. 5 there is a cross-sectional configuration of the shoe of FIG. 2. Here the outer sole 42 is formed of a first material 76 which is embossed as shown by the space 77 to form a figure 78, the figure 78 being the dinosaur body 40. Space 77 could be filled by any foam material or any cushioning material 79. This would represent the outside of the shoe. The inside face of the shoe would have a different material, namely the cushioning layer 80 and an outside material 81. The outside material 81 would be ornamented on its face 82 and would be a suitable plastic material with a simple backing 82 which interfaces with the cushioning material 80. Contrarily, the material 76 includes a face 83, a foam area 84 and a backing 85 which interfaces with the cushioning material 79.

The materials forming the upper can be a suitable thematic material so that printing can effectively be achieved on the surface of the materials. The materials can be suitably formed to constitute footwear. Breathing and comfort characteristics can be provided to the materials according to the desired properties of the shoe. In some cases natural materials, such as untreated or treated leather are used as the upper material. Likewise, a suitable insole 86 can be provided to the shoes as required.

Figure 6:
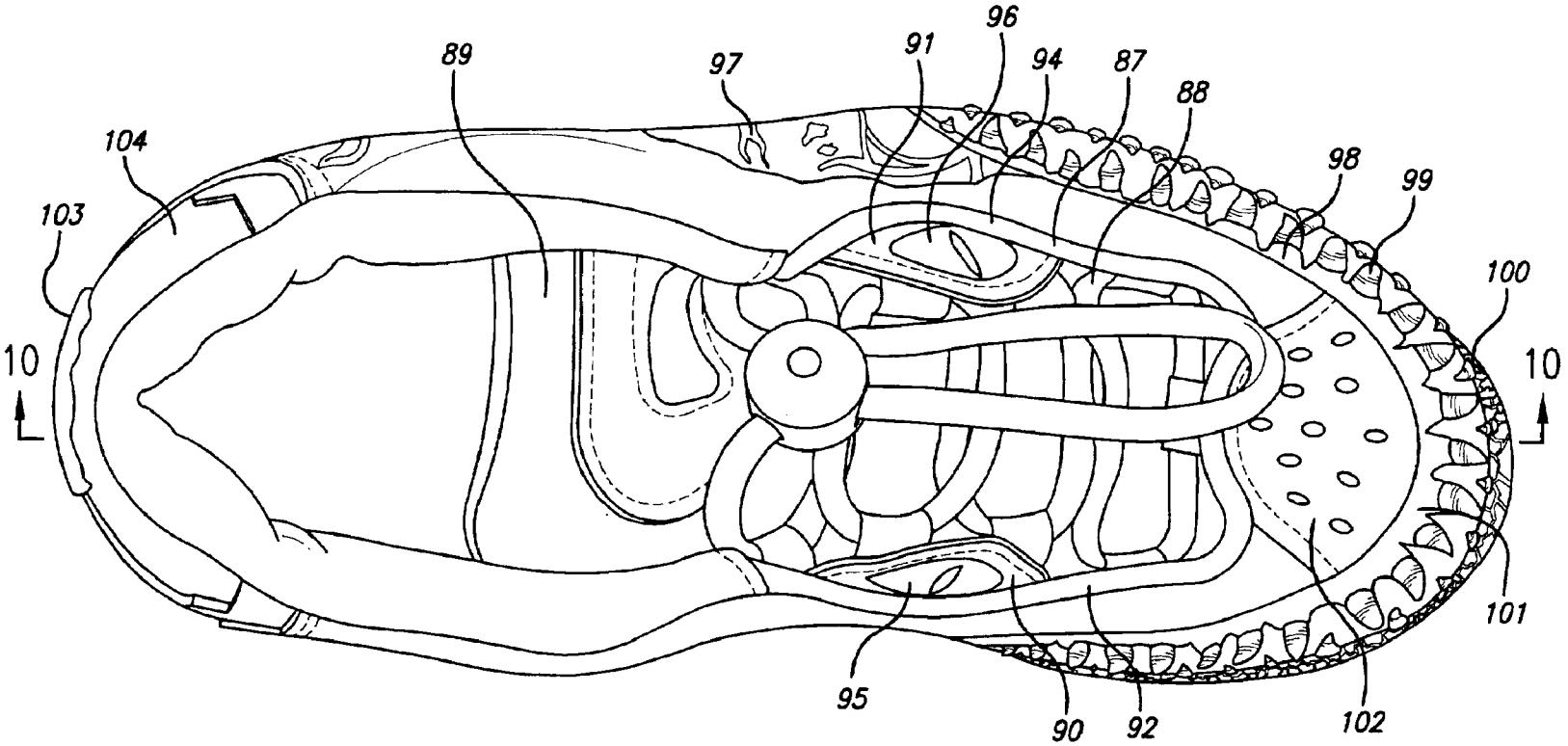
FIG. 6 is a top view of another item of footwear in accordance with the invention.

In FIG. 6 there is shown a configuration where the U throat 87 receiving loops for laces 88 to cover the tongue 89 is formed in a different manner. There are two additional pieces of material 90 and 91 which are provided to enter the throat area. This material is suitably stitched to the edge 92 and 94 of the throat and there is an ornamental representation 95 and 96 provided on those material pieces. These representations 95 and 96 show eyes. As such they represent the eyes of a dinosaur body on the side of the upper. This representation of a shoe shows the dinosaur in a three-dimensional embossed format 97 on the outside of the shoe. There is a similar representation on the inside face of the shoe but this is not visible in this figure.

The toe cap area 28 extends over a longer portion of the front of the shoe and is represented by a three-dimensional or embossed representation 99 of the top jaw and 100 of the bottom jaw of a dinosaur. Representations 99 and 100 would represent teeth of those jaws. Also extending from the toe cap portion 101 there is a artful representation 102 of the nose or front face of a dinosaur type representation. Different artistic representations 102 can be provided. There is also an embossed rear element 103 in the heel portion 104 of the shoe.

The sole of the shoe has the same thematic representation as illustrated in other figures and thus is thematically related to the theme on the upper of the shoe.

Figure 11:
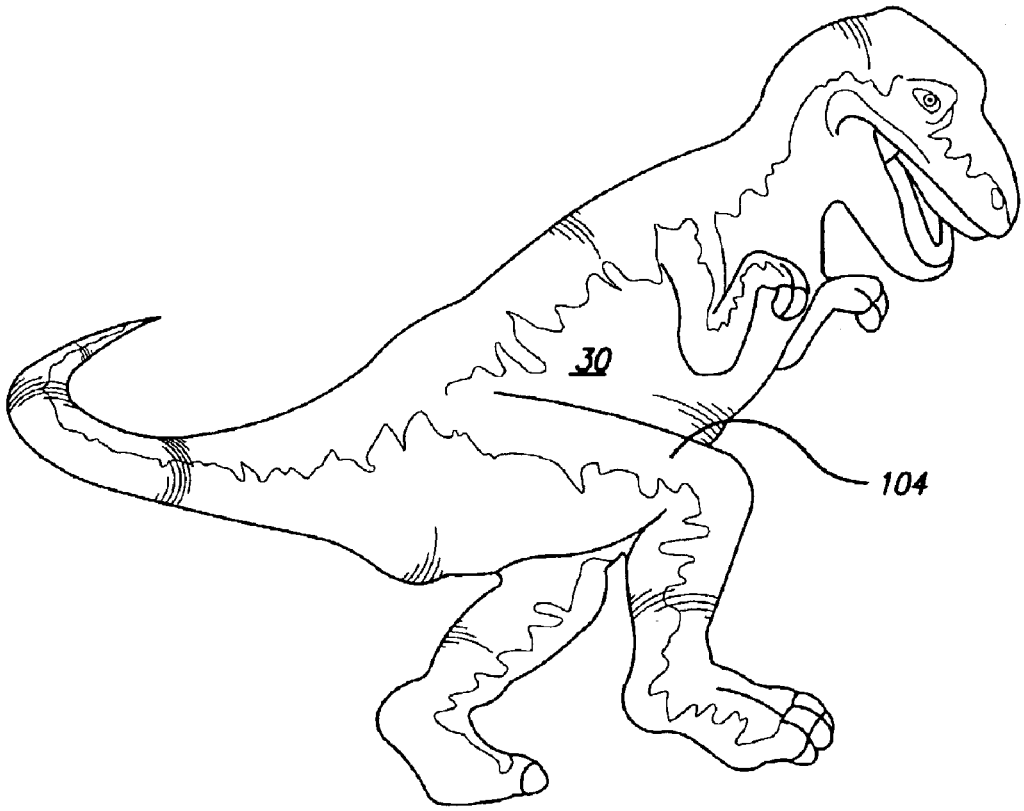
FIG. 11 is a front view of a feature for the footwear in accordance with the invention.
Figure 12:
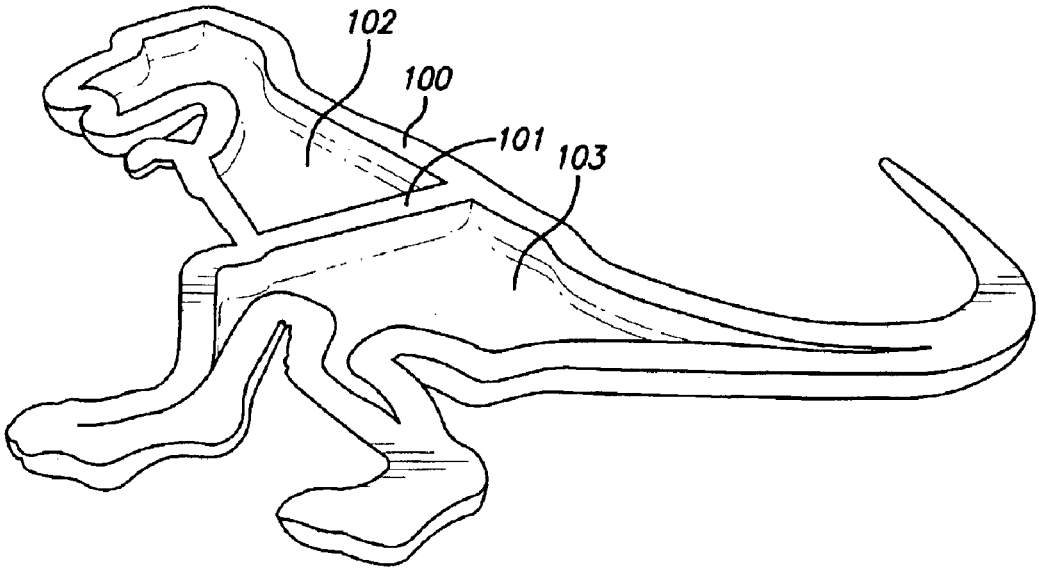
FIG. 12 is a under side of the front view of the feature of FIG. 11 for the footwear in accordance with the invention.

In FIGS. 11 and 12, the feature 30 is formed of a molded flexible rubberized plastic material. As can seen there is peripheral rib 100 which surrounds the feature on the underside. This rib 100 is of a nature that an adhesive can bond the feature to the surface forming the material of the quarters, and vamp of the upper, and side of the sole as necessary. There is also a cross rib 101 formed to extend from one side of the peripheral rib 100 to the other side of the peripheral rib 100. This effectively forms hollowed out areas 102 and 103 between the ribs and the material 104 forming the surface of the feature. This increases the flexibility and tactile feeling of the feature when it is mounted on the surface of the upper, since it can be pushed inwardly as necessary.

Although the invention is being described with regard to different shoe configurations it is clear that any other examples of the invention exist, each differing from others in matters of detail only.

In the one aspect of the invention, the invention relates to a first theme being formed in three dimensions on the shoe upper and having an outsole with a second ornamental theme and having those two themes thematically related.

In yet another aspect of the invention an element of the first theme is formed of the material engaging an underlying substrate forming the upper. That material overlaps the peripheral area and is secured to the peripheral area of the outsole.

The three-dimensional feature can be attained by adhering an element onto the shoe upper and the outsole. In a preferred form the three-dimensional effect on the upper is formed by an embossed profile.

While the invention has been described with reference to a dinosaur it is clear that other applications of the invention are possible. For instance, different animals could be represented on the outside surface of the upper. Ideally an animal walking or moving on the surface is printed or formed on the upper and this relates to the concept of a shoe which moves as a user walks or runs in a shoe. Thus, the idea of an animal format in a moveable mold represented on the upper and translating that ornamental theme into the theme of the outsole.

While the outsole has been represented as caked ground there are iterations where that representation can be rocks, mud or other terrain in which the animal would live.

While the representation has also illustrated the overlapping of the thematic feature from the upper onto the outer sole there are variations of the invention where the outer sole overlaps onto the upper and this is thematically enacted. As such, the outer sole may represent, for instance, waves or a fish and this is translated and transported in an overlap fashion into the theme on the upper of the footwear. As such, the upper could continue to have themes related to the maritime environment.

In other aspects of the invention the features of the upper and the outsole can be made in multi-colors. The colors of the outsole can vary. As such mud and caked rocks can be shown in one color and the footprint of an animal in a different color. The colors of the theme of the outsole can selectively be coordinated with the colors of the first theme of the upper.

As illustrated in FIG. 1, the animal represented on the outside face of the shoe upper does wrap around the front of the shoe and extends to the opposite face of the shoe. As such the theme extends across the upper of the shoe. In FIG. 1 this is effected by the tail of the animal.

In yet other forms of the invention there is provided the features to provide sound and light to elements of the shoe. While it is known to provide sound to footwear and also light to footwear, it is unknown to provide sound and light simultaneously to footwear. Moreover, it is unknown to provide the feature of having the sound and light coordinate with the elements of the theme of the shoe.

Thus there is a configuration, for instance, illustrated in U.S. Pat. No. 5,765,300 the contents of which are incorporated by reference in here which shows a shoe activated sound simulation device. Incorporation of such sound with a switch is part of this invention.

Similarly, the provision of circuitry in the shoe to operate light devices such as LEDs in the eyes of the dinosaur is also part of this invention. A conventional circuit can be provided for powering an LED and a suitable battery is used for that power. This same battery can operate the sound features of the shoe. In the extended, this further embodiment of the invention therefore the attribution of all-around thematic artwork of the shoe is extended by having sound and light features relating to that artwork so that the shoe becomes active in the senses of light and sound and additionally enhanced art. As such, there is provided a shoe and footwear with significant advantages.

A further aspect of the invention is that features of the ornamentation are formed of "glow-in-the-dark" material This may be par to f the printing material or may be part of the attached material on the shoe upper and/or outsole.

The first theme is formed in three dimensions, and the rendition of features of the art is preferably coincident with the three dimensional effects. The outsole below the shoe upper which includes a bottom surface for engagement with a walking surface; and the peripheral area extends about the bottom. Both the bottom surface and the peripheral area have a surface with a second ornamental theme which are thematically related. This surrounds the shoe with ornamentation with a three dimensional effect thereby creating an ornamented shoe. The shoe preferably has a panoramic theme, which is in the nature of the theme is preferably one of intrigue. This effectively converts an essentially functional or utilitarian shoe to wearable surrounding art or ornamented footwear with an intriguing character or personality. Consumers are able to consider the footwear and periodically look for different elements relating to the theme of the shoe.

The invention is to be determined in terms of the following claims.

What is claimed is:

1. A shoe comprising:

a shoe tipper having a volume for enclosing a wearer's foot, an outside surface of the upper having a three-dimensional first ornamental theme, the outside lateral surface formed of a first material, the three dimensional first theme formed of a second material, the first material being different from the second material, at least a portion of the three-dimensional first theme being raised above the outside lateral surface a sole below the shoe upper, the sole comprising a bottom surface for engagement with a walking surface, the bottom surface having a three-dimensional second ornamental theme thematically related with the three-dimensional first ornamental theme; and a peripheral area, visible to third parties during walking of an user of the shoe, the peripheral area having a front region, a back region, and side regions, the peripheral area extending about the sole and mating with the upper along the front region, the back region, and the side regions, the three-dimensional second ornamental theme being further located along the front region, the back region, and the side regions of the peripheral area, the three-dimensional first ornamental theme overlapping the three-dimensional second ornamental theme.

2. A shoe as claimed in claim 1 wherein the upper is formed of at lest two materials, a first material including foam thereby permitting embossing over the surface, and a second material without foam such that the material is not subject to embossing, the two materials being bonded to form en overall appearance for the upper which is partly embossed and partly unembossed.

3. A shoe as claimed in claim 1 including at least one of light emitting elements or sound emitting elements on the shoe, circuit generating means for the light or sound, and a power source for a circuit for the light or sound.

4. A shoe as claimed in claim 1, wherein the first ornamental theme comprises an overlapping portion, the overlapping portion extending to the peripheral area and partially overlaps with the three-dimensional second ornamental theme of the peripheral area.

5. A shoe as claimed in claim 4, wherein the overlapping portion is raised over a surface of the peripheral area.

6. A shoe as claimed in claim 1, wherein the at least a portion of the first theme is raised above the outside surface of the upper by means of a material having an embossed profile.

7. A shoe as claimed in claim 1, wherein the at least a portion of the first theme is formed along a first side of the upper and is raised above the outside surface of the upper by means of a material having an embossed profile, and a further portion of the first theme is formed along a second side of the upper in an unembossed profile.

8. A shoe comprising:

a shoe upper having a volume for enclosing a wearer's foot and including an ankle area, an outside surface of the upper having a three-dimensional first ornamental theme, the first theme being formed of an animal walking on a ground surface, the three-dimensional first ornamental theme extending proximate the ankle area;

a sole below the shoe upper, the sole comprising a bottom surface for engagement with a walking surface;

a peripheral area extending about the sole and mating with the upper, the peripheral area comprising a front region, a back region and side regions; and at least one of the sole or the peripheral area along the front region, back region and side regions having a surface with a three-dimensional second ornamental theme, the three-dimensional second theme including the ground surface on which the animal is represented to walk , the three-dimensional first ornamental theme overlapping the three-dimensional second ornamental theme, the sole including a three-dimensional third ornamental theme comprising an indented footprint of the animal, a ridge separating the indented footprint from a remaining portion of the sole.

9. A shoe as represented in claim 8, wherein the animal is represented to walk by means of animal legs in a walking position.

10. A shoe as represented in claim 9, wherein the animal legs are completely located in the upper.

11. A shoe as represented in claim 9, wherein the animal legs comprise a first leg portion located in the upper and a second leg portion located in the peripheral area.

12. A shoe comprising:

a shoe upper having a volume for enclosing a wearer's foot, an outside surface of the upper having a three-dimensional first ornamental theme, the outside surface comprising an outside lateral surface located on a lateral side of the shoe upper, at least a portion of the three-dimensional first theme raised above the outside lateral surface, the first theme being formed of a dinosaur walking on a ground surface, the dinosaur including a tail feature, at least one portion of the tail feature wrapped round from a first side of the upper to a second side of the upper;

a sole below the shoe upper, the sole comprising a bottom surface for engagement with a walking surface; and a peripheral area extending about the sole and mating with the upper, the peripheral area comprising a front region, a back region and side regions, at least one of the sole or the peripheral area along the front region, back region and side regions having a surface with a three-dimensional second ornamental theme, the three-dimensional second theme including a ground surface on which the dinosaur is represented to walk, and including a three-dimensional representation of caked ground, the caked ground extending to the bottom surface of the sole, and wherein the caked ground selectively represents at least one of mud or rocks, the three-dimensional first ornamental theme overlapping the three-dimensional second ornamental theme, the sole including a tree-dimensional third ornamental theme comprising an indented footprint of the dinosaur, a ridge separating the indented footprint from a remaining portion of the sole.

13. A shoe comprising:

a shoe upper having a volume for enclosing a wearer's foot, an outside surface of the upper having a three-dimensional first ornamental theme, the three-dimensional first ornamental theme molded and affixed to the outside surface of the upper, the first theme being formed of a dinosaur walking an a ground surface the dinosaur including a tail feature, at least one portion of the tail feature wrapped around from a first side of the upper to a second side of the upper;

a sole below the shoe upper, the sole comprising a bottom surface for engagement with a walking surface; and a peripheral area extending about the sole and mating with the upper, at least one of the sole or the peripheral area having a surface with a three-dimensional second ornamental theme, the three-dimensional second theme including a ground surface on which the dinosaur is represented to walk, and including representation of caked ground, the caked ground extending to the bottom surface of the sole and wherein the caked ground selectively represents at least one of mud or rocks, the bottom surface including a three-dimensional third ornamental theme comprising an indentation of a footprint of the dinosaur a ridge separating the footprint from a remaining portion of the sole.

14. A shoe as claimed in claim 12 or 13 wherein the dinosaur includes a tail feature, the tail feature being made to at least partially wrap around a front of the upper from one side of the upper the another side of the upper.

15. A shoe as claimed in claim 12 or 13 wherein the dinosaur includes a mouth feature, the mouth feature being made to at least partially wrap around a front toe region of the upper from one side of the upper the another side of the upper, the mouth feature being formed selectively of an unembossed profile.

16. A shoe comprising:

a shoe upper having a volume for enclosing a wearer's foot and including an ankle area, an outside surface of the upper having a three-dimensional first ornamental theme, the outside surface comprising an outside lateral surface located on a lateral side of the shoe upper, the outside lateral surface formed of a first material, the three dimensional first theme formed of a second material, the first material being different from the second material, at least a portion of the three-dimensional first theme raised above the outside lateral surface, the first theme being formed of a three-dimensional feature moving over a terrain, the three-dimensional first ornamental theme extending proximate the ankle area;

a sole below the shoe upper, the sole comprising a bottom surface for engagement with a walking surface; and a peripheral area extending about the bottom and mating with the upper, at least one of the sole or the peripheral area having a surface with a three-dimensional second ornamental theme, the three-dimensional second theme including a terrain on which the feature is represented to move.

17. A shoe as claimed in claim 8, 12, 13, or 16 including an embossed profile of the three-dimensional first ornamental theme, and wherein the upper is formed of at least two materials, a first material including foam thereby permitting embossing over the outside surface of the upper, and a second material without foam such that the second material is not subject to embossing, the two materials being bonded to form an overall appearance for the upper which is partly embossed and partly unembossed.

18. A shoe as claimed in claim 1, 8, 12, 13, or 16 wherein at least one of the sole or peripheral area is formed in multiple colors, and wherein the colors are selectively coordinated to colors of the first theme of the upper.

19. A shoe comprising a shoe upper, a lateral surface and a bottom walking surface, wherein the lateral surface is integral with the bottom walking surface, the shoe upper including and ankle area and comprising a first ornamental theme, the lateral surface and the bottom walking surface comprising a three-dimensional second ornamental theme related to the first ornamental theme, the first ornamental theme comprising a raised portion on an outside lateral surface of the shoe upper, the first ornamental theme representing a walking animal, the three-dimensional second ornamental theme representing a terrain on which the walking animal is supposed to walk, the first ornamental theme overlapping with the second ornamental theme surface, the first three-dimensional ornamental theme extending proximate the ankle area.

20. The shoe of claim 19, wherein the bottom walking surface comprises an internal bottom surface portion and an external bottom surface portion surrounding the internal bottom surface portion, the external bottom surface portion representing the three-dimensional second ornamental theme, and the internal bottom surface portion representing an indented footprint of the walking animal.

21. The shoe of claim 19, wherein the walking animal is a dinosaur.

22. A shoe comprising a shoe upper, a lateral surface and a bottom walking surface, the shoe upper comprising a walking dinosaur theme, at least a portion of the walking dinosaur theme raised above an outside lateral surface of the shoe upper, the walking dinosaur theme molded and affixed to the outside lateral surface of the upper, the lateral surface comprising a front region, a back region and side regions, the lateral surface and the bottom surface comprising a three-dimensional terrain theme representing a terrain on which the walking dinosaur is supposed to walk, the three-dimensional terrain located along the front region, the back region and the side regions of the lateral surface, wherein the dinosaur theme has an overlapping portion which partially overlaps with the terrain theme along the lateral surface, the bottom surface including an indented three-dimensional footprint of the dinosaur.

23. The shoe of claim 22, wherein the shoe upper has an outside surface, and the dinosaur theme comprises a raised portion raised above the outside surface of the shoe upper.

24. The shoe of claim 23, wherein the overlapping portion forms part of the raised portion.

25. A shoe comprising:

a shoe upper having a volume for enclosing a wearer's foot, an outside surface of the upper having a three-dimensional first ornamental theme, the outside surface comprising an outside lateral surface located on the lateral side of the shoe upper, at least a portion of the three-dimensional first theme being raised above the outside lateral surface of the upper, the dinosaur including a tail feature, at least one portion of the tail feature wrapped around from a first side of the upper to a second side of the upper;

a sole below the shoe upper, the sole comprising a bottom surface for engagement with a walking surface, the bottom surface having a three-dimensional second ornamental theme thematically related with the first ornamental theme; and a peripheral area, visible to third parties during walking of an user of the shoe, the peripheral area having a front region, a back region, and side regions, the peripheral area extending about the sole and mating with the upper along the front region, the back region, and the side regions, the three-dimensional second ornamental theme being further located along the front region, the back region, and the side regions of the peripheral area, at least portion of the three-dimensional first ornamental theme overlapping with the three-dimensional second ornamental theme.

* * * * *